US009775402B2

(12) United States Patent
Nonogawa et al.

(10) Patent No.: US 9,775,402 B2
(45) Date of Patent: Oct. 3, 2017

(54) SHOE SOLE HAVING OUTSOLE AND MIDSOLE

(75) Inventors: Mai Nonogawa, Kobe (JP); Kenji Sakamoto, Kobe (JP); Seigo Nakaya, Kobe (JP); Rena Furuishi, Kobe (JP); Toshihiko Nakamura, Kobe (JP)

(73) Assignee: ASICS CORPORATION (JP)

( * ) Notice: Subject to any disclaimer, the term of this patent is extended or adjusted under 35 U.S.C. 154(b) by 0 days.

(21) Appl. No.: 14/398,429

(22) PCT Filed: May 10, 2012

(86) PCT No.: PCT/JP2012/061982
§ 371 (c)(1),
(2), (4) Date: Oct. 31, 2014

(87) PCT Pub. No.: WO2013/168256
PCT Pub. Date: Nov. 14, 2013

(65) Prior Publication Data

US 2015/0082668 A1 Mar. 26, 2015

(51) Int. Cl.
*A43B 13/14* (2006.01)
*A43B 13/16* (2006.01)
(Continued)

(52) U.S. Cl.
CPC ..... *A43B 13/14* (2013.01); *A43B 5/10* (2013.01); *A43B 7/142* (2013.01); *A43B 7/143* (2013.01);
(Continued)

(58) Field of Classification Search
CPC ..... A43B 13/188; A43B 13/12; A43B 13/14; A43B 13/16; A43B 13/127; A43B 5/10;
(Continued)

(56) References Cited

U.S. PATENT DOCUMENTS 5,014,706 A * 5/1991 Philipp ..... A43B 7/141 36/140
5,255,451 A * 10/1993 Tong ..... A43B 3/0057 36/28
(Continued)

FOREIGN PATENT DOCUMENTS

EP 1352579 A1 10/2003
JP S60-60905 4/1985
(Continued)

OTHER PUBLICATIONS

White, Rick; "Shore Durometer Conversion Chart"; Thermal Tech Equipment Co, Inc. http://www.ttequip.com/knowledgelibrary/TechPageShoreDurometerConversionChart.htm.*
(Continued)

*Primary Examiner* — Khoa Huynh
*Assistant Examiner* — Jocelyn Wu
(74) *Attorney, Agent, or Firm* — Katten Muchin Rosenman LLP

(57) ABSTRACT

A shoe sole including an outsole 2 and a midsole 1, wherein: the midsole 1 includes a lower midsole 4 of a lower layer formed by a foamed body of a resin, and an upper midsole 3 of an upper layer formed by a foamed body of a resin and arranged on the lower midsole 4; a lateral roll-up portion 42 for supporting a lateral side of a foot from a side of the foot is formed integrally with the lower midsole 4; a hardness of a lateral portion 40 of the lower midsole 4 including the lateral roll-up portion 42 is a first hardness; a hardness of a medial portion 41 of the lower midsole 4 is a second hardness lower than the first hardness; a hardness of a lateral portion 30 of the upper midsole 3 is a third hardness lower than the first hardness; and a part or a whole of the high-hardness lateral roll-up portion 42 is protruding in an upward direction past the upper midsole 3 on a lateral side of the upper midsole 3 so that the lateral side of the foot is
(Continued)

supported by the lateral roll-up portion 42 from the side of the foot without being supported by the upper midsole 3 from the side of the foot.

11 Claims, 8 Drawing Sheets

(51) Int. Cl.
*A43B 13/12* (2006.01)
*A43B 13/18* (2006.01)
*A43B 5/10* (2006.01)
*A43B 7/14* (2006.01)

(52) U.S. Cl.
CPC ..... *A43B 7/144* (2013.01); *A43B 7/1425* (2013.01); *A43B 13/127* (2013.01); *A43B 13/16* (2013.01); *A43B 13/188* (2013.01)

(58) Field of Classification Search
CPC ..... A43B 7/142; A43B 7/1425; A43B 7/143; A43B 7/144
USPC ..... 36/30 R
See application file for complete search history.

(56) References Cited

U.S. PATENT DOCUMENTS 5,367,791 A * 11/1994 Gross ..... A43B 13/26 36/25 R
5,542,196 A * 8/1996 Kantro ..... A43B 1/0045 36/174
5,718,063 A 2/1998 Yamashita et al.
5,815,950 A * 10/1998 Wang ..... A43B 1/0072 36/137
D416,381 S 11/1999 Senda et al.
6,131,311 A * 10/2000 Brown ..... A43B 7/142 36/145
6,199,302 B1 3/2001 Kayano
6,212,795 B1 4/2001 Nakabe et al.
6,255,235 B1 7/2001 Hiraoka et al.
6,374,514 B1 * 4/2002 Swigart ..... A43B 13/20 36/141
6,438,870 B2 8/2002 Nasako et al.
6,467,197 B1 10/2002 Mitsui et al.
6,516,539 B2 2/2003 Nishiwaki et al.
6,562,271 B2 5/2003 Hiraoka et al.
6,647,646 B2 11/2003 Mitsui et al.
6,662,471 B2 * 12/2003 Meschan ..... A43B 21/26 36/27
6,685,011 B2 2/2004 Nishiwaki et al.
6,763,615 B2 7/2004 Mitsui et al.
D495,859 S 9/2004 Kubo et al.
D495,860 S 9/2004 Kubo et al.
D496,148 S 9/2004 Kayano et al.
6,789,333 B2 9/2004 Nishiwaki et al.
D501,713 S 2/2005 Kayano et al.
D501,987 S 2/2005 Kubo et al.
6,920,707 B1 * 7/2005 Greene ..... A43B 3/26 36/28
D509,351 S 9/2005 Kayano et al.
D512,208 S 12/2005 Kubo et al.
D512,818 S 12/2005 Mitani et al.
D512,819 S 12/2005 Usuki et al.
D512,827 S 12/2005 Usuki et al.
D512,828 S 12/2005 Kubo et al.
D513,115 S 12/2005 Kayano et al.
D514,286 S 2/2006 Kayano et al.
D518,283 S 4/2006 Kayano et al.
7,020,988 B1 * 4/2006 Holden ..... A43B 7/1425 36/141
D520,732 S 5/2006 Mitani et al.
D522,229 S 6/2006 Kubo et al.
D527,174 S 8/2006 Kayano et al.
7,082,699 B2 8/2006 Nishiwaki et al.
D527,516 S 9/2006 Kayano et al.
D528,761 S 9/2006 Kayano et al.
7,121,020 B1 * 10/2006 Bathum ..... A43B 3/128 36/102
D542,522 S 5/2007 Fujita et al.
7,254,907 B2 8/2007 Nishiwaki et al.
D553,846 S 10/2007 Kayano et al.
7,278,226 B2 * 10/2007 Holden ..... A43B 7/1425 36/103
D561,434 S 2/2008 Fujita et al.
7,325,323 B2 2/2008 Katsu et al.
D571,086 S 6/2008 Yamashita et al.
D571,090 S 6/2008 Fujita et al.
D575,486 S 8/2008 Yamashita et al.
D575,946 S 9/2008 Mitani et al.
7,613,588 B2 11/2009 Katsu et al.
7,647,709 B2 * 1/2010 Reilly ..... A43B 7/142 36/107
7,779,558 B2 8/2010 Nishiwaki et al.
7,823,298 B2 11/2010 Nishiwaki et al.
7,832,118 B2 * 11/2010 Holden ..... A43B 7/1425 36/103
7,877,899 B2 2/2011 Nishiwaki et al.
7,954,257 B2 * 6/2011 Banik ..... A43B 7/144 36/28
7,987,618 B2 8/2011 Nishiwaki et al.
8,008,363 B2 8/2011 Mori et al.
8,056,261 B2 * 11/2011 Nakano ..... A43B 7/14 36/27
D650,566 S 12/2011 Yamashita et al.
8,074,377 B2 12/2011 Nishiwaki et al.
8,112,909 B2 2/2012 Kubo et al.
D659,371 S 5/2012 Yano et al.
8,250,784 B2 * 8/2012 Cheskin ..... A43B 7/141 36/144
8,272,148 B2 9/2012 Nishiwaki et al.
8,418,379 B2 4/2013 Nishiwaki et al.
8,453,344 B2 6/2013 Nishiwaki et al.
8,461,222 B2 6/2013 Mori et al.
8,544,190 B2 10/2013 Nishiwaki et al.
8,650,775 B2 * 2/2014 Peyton ..... A43B 7/144 36/28
8,713,821 B2 5/2014 Nishiwaki et al.
8,819,961 B1 * 9/2014 Ellis ..... A43B 7/1415 36/140
9,003,679 B2 * 4/2015 Baucom ..... A43B 13/188 36/25 R
D734,927 S 7/2015 Ando et al.
D734,928 S 7/2015 Ando et al.
9,089,185 B2 7/2015 Nishiwaki et al.
2002/0092203 A1 * 7/2002 Hardt ..... A43B 7/142 36/43
2003/0192202 A1 * 10/2003 Schoenborn ..... A43B 7/142 36/30 R
2003/0200678 A1 * 10/2003 Nishiwaki ..... A43B 7/1425 36/28
2004/0098882 A1 * 5/2004 Tuan ..... A43B 7/144 36/29
2004/0177530 A1 * 9/2004 Nishiwaki ..... A43B 7/1425 36/28
2004/0181971 A1 * 9/2004 Turkbas ..... A43B 7/141 36/44
2005/0150133 A1 * 7/2005 Khoury ..... A43B 7/142 36/29
2005/0262728 A1 * 12/2005 Robbins ..... A43B 3/0078 36/16
2005/0268490 A1 * 12/2005 Foxen ..... A43B 7/1425 36/28
2006/0080862 A1 * 4/2006 Hay ..... A43B 7/142 36/25 R
2006/0112600 A1 * 6/2006 Khoury ..... A43B 7/142 36/154
2006/0156581 A1 * 7/2006 Holden ..... A43B 7/1425 36/29
2006/0201028 A1 * 9/2006 Chan ..... A43B 7/142 36/28

(56) References Cited

U.S. PATENT DOCUMENTS

2006/0213083 A1* 9/2006 Nishiwaki ..... A43B 7/1425 36/30 R
2006/0218819 A1* 10/2006 Wu ..... A43B 1/0027 36/28
2007/0017122 A1* 1/2007 Feller ..... A43B 1/0072 36/35 R
2007/0068039 A1* 3/2007 Nau ..... A43B 3/0036 36/25 R
2007/0240333 A1* 10/2007 Le ..... A43B 5/08 36/30 R
2007/0295451 A1* 12/2007 Willis ..... A43B 7/144 156/306.6
2008/0289215 A1* 11/2008 Park ..... A43B 7/144 36/28
2008/0289220 A1* 11/2008 Rivas ..... A43B 3/0036 36/88
2009/0019729 A1* 1/2009 Nakano ..... A43B 7/14 36/91
2009/0019730 A1* 1/2009 Salminen ..... A43B 7/1425 36/91
2009/0288314 A1* 11/2009 Kay ..... A43B 5/185 36/91
2010/0287792 A1* 11/2010 Hide ..... A43B 5/10 36/114
2010/0293811 A1* 11/2010 Truelsen ..... A43B 5/06 36/28
2011/0030245 A1* 2/2011 Truelsen ..... A43B 5/06 36/30 R
2011/0099845 A1* 5/2011 Miller ..... A43B 7/142 36/91
2011/0179679 A1* 7/2011 Clark ..... A43B 1/0072 36/30 R
2011/0185590 A1* 8/2011 Nishiwaki ..... A43B 5/06 36/28
2011/0197468 A1 8/2011 Kubo et al.
2012/0030971 A9* 2/2012 Truelsen ..... A43B 5/06 36/30 R
2012/0151793 A1* 6/2012 Lin ..... A43B 7/148 36/28
2012/0159814 A1* 6/2012 Smith ..... A43B 1/0081 36/92
2012/0216422 A1 8/2012 Ikezawa et al.
2012/0233877 A1* 9/2012 Swigart ..... A43B 7/223 36/28
2013/0000146 A1* 1/2013 Brandstatter ..... A43B 7/141 36/28
2013/0008053 A1 1/2013 Nishiwaki et al.
2013/0019505 A1* 1/2013 Borel ..... A43B 13/127 36/103
2013/0086823 A1* 4/2013 Park ..... A43B 7/082 36/30 R
2013/0125425 A1* 5/2013 Crowley, II ..... A43B 13/181 36/30 R
2013/0232824 A1* 9/2013 Bier ..... A43B 7/087 36/3 A
2014/0075777 A1* 3/2014 Bruce ..... A43B 13/20 36/29
2014/0075778 A1* 3/2014 Bruce ..... A43B 13/184 36/29
2014/0075779 A1* 3/2014 Bruce ..... A43B 13/20 36/29
2014/0173945 A1* 6/2014 Lin ..... A43B 17/006 36/30 R
2014/0259788 A1* 9/2014 Dojan ..... A43B 1/0018 36/103
2015/0013183 A1* 1/2015 Ellis ..... A43B 7/1415 36/44
2015/0135558 A1 5/2015 Inomata et al.
2015/0143723 A1 5/2015 Tateishi et al.
2015/0181975 A1 7/2015 Otsuka et al.
2015/0250260 A1 9/2015 Bessho et al.
2015/0272269 A1* 10/2015 Niskanen ..... A43B 7/1425 36/30 R
2015/0282559 A1 10/2015 Nishiwaki et al.

FOREIGN PATENT DOCUMENTS

JP 2004-242692 A 9/2004
JP 2005-224335 A 8/2005
JP 2007-135824 A 6/2007
JP 2007-236918 A 9/2007
WO WO-2010/137068 A1 12/2010

OTHER PUBLICATIONS

"Flexible Solutions: Hard or Soft?"; Hexpol TPE http://www.hexpoltpe.com/getfile.php?type=site_documents&id=polymer-hardness.pdf.*

* cited by examiner

Lf
Lm
Lℓ
VIA
VIA
44
3
31
34
30
41
33
35
40
VIB
VIB
4
VIC
VIC
IN
Lb
OUT
VID
VID
X

4e
Lf
3e

B1₁
Lm
B2₂
Lℓ
3
31
MP₃
B3₂
B1₅
B3₁
B3₄
30
33
42f
41
40
B3₅
O1
42
B4₂
MP₅
B4₁
4
O5
O11
42b
IN
Lb
B4₅
OUT
J
J
O51
Y
X

FIG. 7A
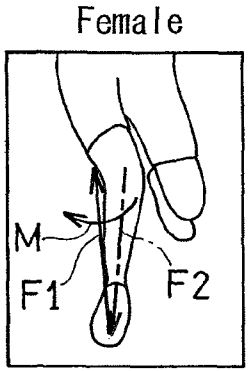
FIG. 7B
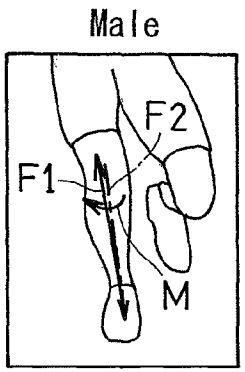
FIG. 7C
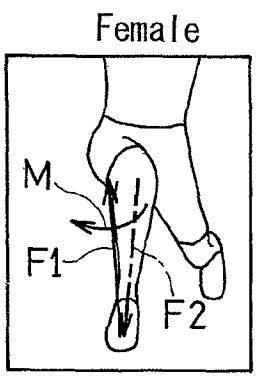
FIG. 7D
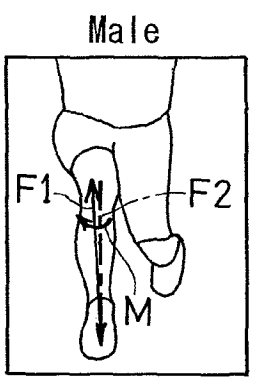
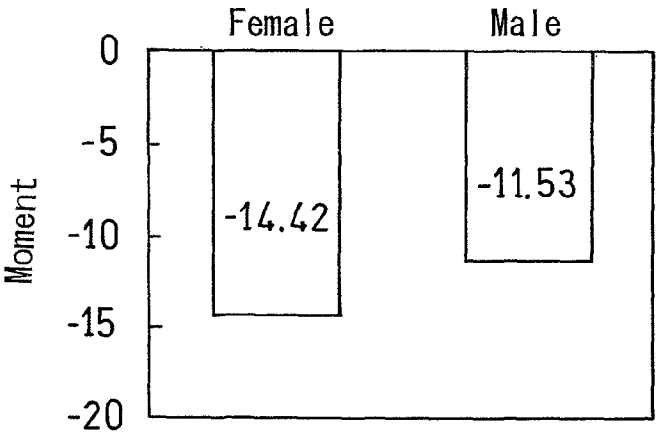
FIG. 7E
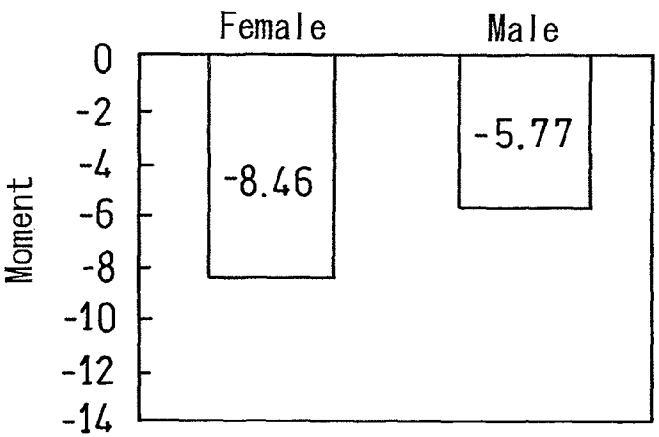
FIG. 7F

SHOE SOLE HAVING OUTSOLE AND MIDSOLE

CROSS-REFERENCE TO RELATED APPLICATIONS

This patent application is a U.S. National Phase application under 37 U.S.C. §371 of Patent Cooperation Treaty Application No. PCT/JP2012/061982, filed on May 10, 2012, entitled "Shoe Provided With Outer Sole and Midsole," the contents of which are incorporated herein by reference in entirety.

TECHNICAL FIELD

The present invention relates to a structure of a shoe sole suitable for court sports such as tennis and basketball, for example.

BACKGROUND ART

In court sports such as tennis and basketball, one is likely to suddenly change direction or stop while running, or use footwork in a lateral direction or a diagonally lateral direction. During such a footwork, a lateral shake (vibration) is likely to occur in which the foot is urged to move in the lateral-medial direction inside the shoe. In order to realize a stable footwork, it is necessary to prevent such a lateral shake.

CITATION LIST

Patent Literature

First Patent Document: JP2007-135824A

Second Patent Document: Japanese Laid-Open Utility Model Publication No. 60-60905

SUMMARY OF INVENTION

The first and second patent documents disclose increasing the hardness of a lateral portion of the midsole. Such a structure is likely to support the force acting upon the lateral side of the foot when changing directions in a court sport, etc.

Also in the first patent document, the lateral portion of the midsole having a high hardness is rolled up, and such a roll-up portion serves to prevent a lateral shake.

However, there is a hard outsole layer underneath, and if the upper-layer midsole apart from the bending neutral axis upon bending the sole alone is hard, the bending rigidity of the sole as a whole upon bending may be excessively high. As a result, the bendability of the sole may lower, thereby lowering the athletic functionality.

Also, if the upper-layer midsole is hard, since the layer close to the foot sole is hard, the impact of landing is likely to occur on the foot sole.

On the other hand, if the hardness of the roll-up portion decreases, the roll-up portion is likely to collapse and the roll-up portion is likely to be compressed by the resin stabilizer, whereby the lateral shake is likely to increase.

Thus, an object of the first invention, related to a shoe sole, is to improve the lateral shake preventing function while preventing the lowering of the bendability of the sole and the lowering of the impact-absorbing property via the midsole in the vicinity of the foot sole.

There are skeletal and muscular differences between legs and feet of men and those of women, and there is a large difference in the moment (torque) around the knee upon landing in tennis, or the like.

If the moment around the knee is large, there is a large load on the knee.

Thus, an object of the second invention is to provide tennis shoes for women, etc., with which the moment around the knee is reduced.

The first invention in one aspect is a shoe sole including an outsole 2 having a tread surface to be in contact with a road surface, and a midsole 1 arranged on the outsole 2, wherein:

the midsole 1 includes a lower midsole 4 of a lower layer formed by a foamed body of a resin, and an upper midsole 3 of an upper layer formed by a foamed body of a resin and arranged on the lower midsole 4;

a lateral roll-up portion 42 for supporting a lateral side of a foot from a side of the foot is formed integrally with the lower midsole 4;

a hardness of a lateral portion 40 of the lower midsole 4 including the lateral roll-up portion 42 is a first hardness;

a hardness of a medial portion 41 of the lower midsole 4 is a second hardness lower than the first hardness;

a hardness of a lateral portion 30 of the upper midsole 3 is a third hardness lower than the first hardness; and a part or a whole of the high-hardness lateral roll-up portion 42 is protruding in an upward direction past the upper midsole 3 on a lateral side of the upper midsole 3 so that the lateral side of the foot is supported by the lateral roll-up portion 42 from the side of the foot without being supported by the upper midsole 3 from the side of the foot.

According to the first invention, the hardness of the lateral portion 40 of the lower midsole 4 and the lateral roll-up portion 42 is higher than the hardness of the medial portion 41 and the lateral portion 30 of the upper midsole 3, and therefore the lateral roll-up portion 42 is supported by the hard lateral portion 40 of the lower midsole 4 and will unlikely collapse. The hard lateral roll-up portion 42 will unlikely be deformed in compressive deformation. Therefore, it is easy to prevent a lateral shake on the lateral side.

On the other hand, the hardness of the lateral portion 30 of the upper midsole 3 is low as compared with the lateral roll-up portion 42. Therefore, the lateral portion 30 of the upper midsole 3 is likely to conform to the unevenness of the foot sole, and the bendability of the sole may be less likely to be detracted from. The impact-absorbing property is also less likely to be detracted from.

That is, even if there is a hard outsole layer underneath, the upper-layer midsole apart from the bending neutral axis upon bending the sole alone is not hard, and therefore the bending rigidity of the sole as a whole may not become excessively high. As a result, the bendability of the sole is unlikely to lower, and it may be possible to prevent the athletic functionality from lowering.

Since the upper-layer midsole is not hard and therefore the layer close to the foot sole is soft, an impact upon landing will unlikely be imparted on the foot sole.

Incidentally, a rubber outsole and a stabilizer made of a non-foamed body of a resin have been used to support the lateral side of the foot from the side. However, these members are harder and heavier than the foamed body of a resin of the midsole, and will therefore likely lead to a decrease in the athletic functionality such as foot bendability. In contrast, in the present shoe sole, the roll-up portion is formed by the midsole made of a foamed body of a resin, thereby realizing an appropriate hardness and a light weight, and therefore it will unlikely lead to a decrease in the bendability of the foot or a decrease in the athletic functionality.

BRIEF DESCRIPTION OF DRAWINGS

FIGS. 7A, 7B, 7C, and 7D are schematic front views each showing an action of a subject, and FIGS. 7E and 7F are graphs showing the test results.

DESCRIPTION OF EMBODIMENTS

Figure 1:
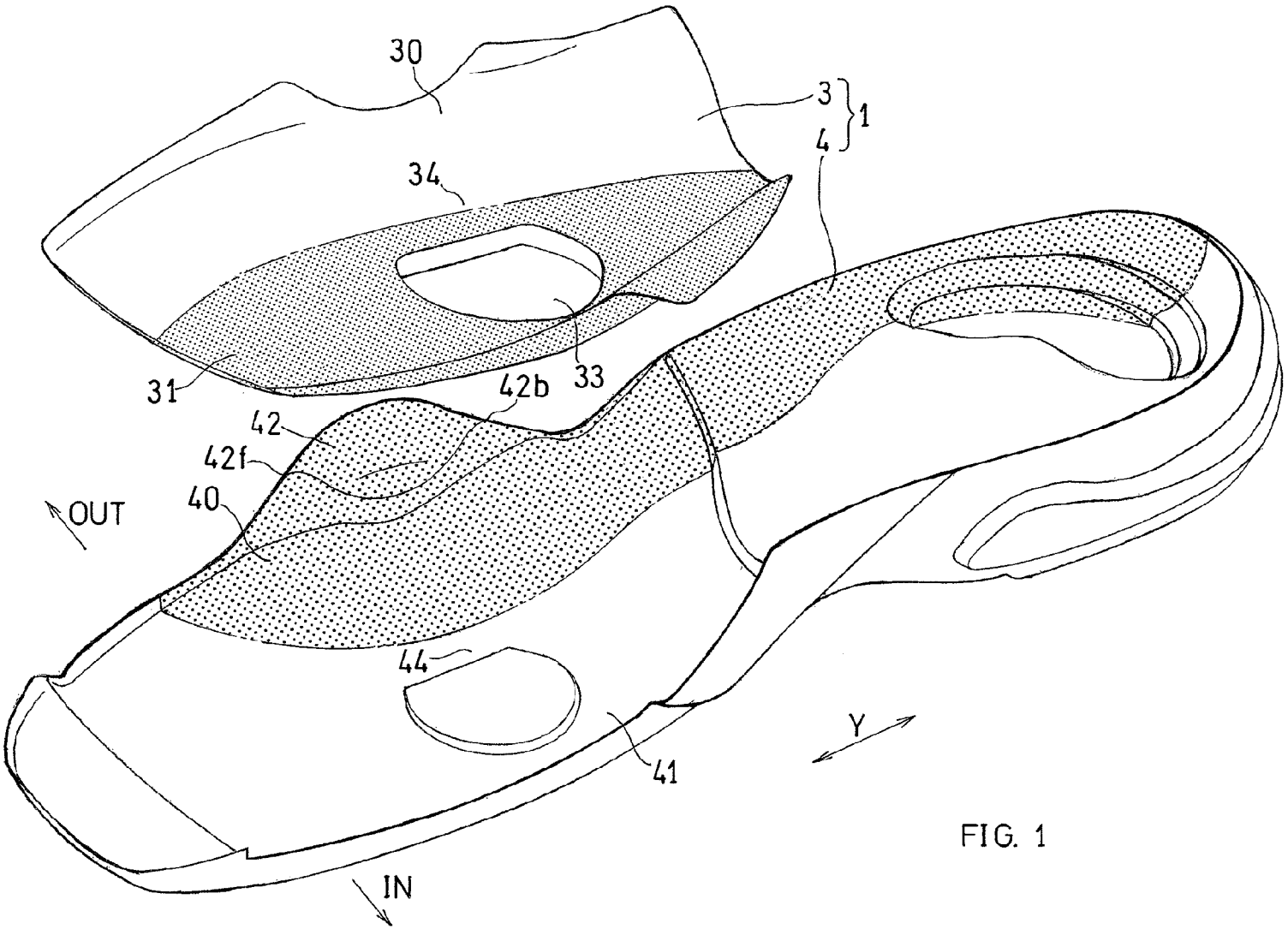
FIG. 1 is an exploded perspective view showing a midsole according to Embodiment 1 of the present invention.

In the first invention, in a preferred example, the lateral portion 30 of the upper midsole 3 supports a lower surface of a lateral side of a fore foot section of the foot; and the high-hardness lateral roll-up portion 42 of the lower midsole 4 covers a lateral side surface of a head 05 of a metatarsal bone of a fifth toe so as to support a lateral side of the head 05 in the fore foot section.

Although a large force, which may cause a lateral shake, occurs at the head 05 of the metatarsal bone of the fifth toe when making a turn, or the like, the lateral side of the head 05 of the metatarsal bone of the fifth toe is supported by the high-hardness lateral roll-up portion 42 in the present embodiment. This will prevent the lateral shake of the head 05 of the metatarsal bone of the fifth toe, i.e., the ball of the little toe.

More preferably, the high-hardness lateral portion 40 of the lower midsole 4 covers a lower surface of the metatarsal bone of the fifth toe from the head 05 to a bottom 051 thereof; and the low-hardness medial portion 41 of the lower midsole 4 covers a lower surface of a metatarsal bone of a first toe from a head 01 to a bottom 011 thereof and a lower surface of a proximal phalanx $B3_1$.

In such a case, the hardness of the medial portion 41 of the lower midsole 4 is lower than the hardness of the lateral portion 40, and therefore the bendability of the sole may be less likely to be detracted from. Moreover, the impact-absorbing property is less likely to be detracted from.

Note that a bottom refers to a portion of each bone that is close to the posterior joint and that is slightly expanding to a greater thickness and it is referred to also as a proximal head. On the other hand, a head refers to a portion of each bone that is close to the anterior joint and that is slightly expanding to a greater thickness and it is referred to also as a distal head. A shaft refers to a portion between the bottom and the head, and the thickness thereof typically changes smoothly.

More preferably, the lateral portion 30 of the upper midsole 3 is narrowed in an area of the metatarsal bone of the fifth toe; and the lateral roll-up portion 42 of the lower midsole 4 is rolled up in an upward direction in the area of the narrowed upper midsole 3.

In such a case, as the lateral portion 30 of the upper midsole 3 is narrowed in the area of the metatarsal bone of the fifth toe, the lateral roll-up portion 42 rises from the lower midsole 4 without the volume of the lateral roll-up portion 42 of the lower midsole 4 decreasing and without the volume of the area extending from the lateral portion 40 of the lower midsole 4 to the lateral roll-up portion 42 decreasing. Therefore, with the hard lateral roll-up portion 42, it is possible to prevent the lateral shake of the head 05 of the metatarsal bone of the fifth toe.

In another preferred embodiment, a hardness of a medial portion 31 of the upper midsole 3 is a fourth hardness lower than the second hardness and the third hardness.

In such a case, since the medial portion 31 of the upper midsole 3 is soft, the upper surface of the midsole will be tilted in a diagonally downward direction from the lateral side toward the medial side upon landing on one foot. Therefore, with tennis shoes for women, or the like, a moment which would be a burden on the knee is unlikely to occur upon landing on one foot.

More preferably, the lateral portion 30 of the upper midsole 3 covers a lower surface of the metatarsal bone of the fifth toe from the head 05 to the bottom 051 thereof; and the medial portion 31 of the upper midsole 3 covers a lower surface of the metatarsal bone of the first toe from the head 01 to the bottom 011 thereof and a lower surface of the proximal phalanx $B3_1$.

In such a case, it will be easy to prevent the occurrence of a moment which would be a burden on the knee.

Preferably, the shoe sole further includes a stabilizer 5, made of a non-foamed body of a resin, for example, arranged along a lateral side surface of the lateral roll-up portion 42 further on a lateral side of the lateral roll-up portion 42.

The stabilizer 5 formed by a non-foamed body of a resin further enhances the lateral shake preventing function.

Preferably, the outsole 2 is formed by a foamed body or a non-foamed body of a rubber and is rolled up in an upward direction further on a lateral side of the lateral roll-up portion 42.

The roll-up of the outsole 2 will further enhance the lateral shake preventing function.

Prior to the detailed description of the second invention, a test conducted by the inventors of the second invention will be described.

Using shoes of the same structure, male and female subjects performed a one-foot-landing action as seen when landing after a jump serve or when volleying, as shown in FIGS. 7A to 7D, and the moments M (torques) occurring about the knee were measured. As a result, it was found that the moment M was greater for females than for males.

The moment M about the knee is calculated as the outer product between the ground reaction force vector F1, extending from the center of load indicated by a solid line in the figures, and the lower limb vector F2 indicated by a one-dot-chain line. FIGS. 7E and 7F are bar graphs showing the magnitudes of the moments M for males and females, indicating that females have a greater moment M than males.

If a low-hardness midsole layer is inserted in the medial portion of the fore foot portion, the low-hardness midsole is compressed significantly, thereby tilting the sole toward the medial side, upon stepping in during the one-foot-landing action. When the sole is tilted toward the medial side, the ground reaction force vector F1 shown in FIGS. 7A and 7C is similarly tilted, but the lower limb vector F2 hardly changes. Therefore, the ground reaction force vector F1 and the lower limb vector F2 will be of the same direction, and the moment M around the knee, which is calculated from the outer product therebetween, will be small.

Thus, the second invention in one aspect is a shoe sole including an outsole 2 having a tread surface to be in contact with a ground upon landing, and a midsole 1 arranged on the outsole 2, wherein:

the midsole 1 includes a lower midsole 4 of a lower layer formed by a foamed body of a resin for supporting a fore foot section of a foot, and an upper midsole 3 of an upper layer formed by a foamed body of a resin and arranged on the lower midsole 4 in the fore foot section; and a hardness of a medial portion 31 of a fore foot section of the upper midsole 3 is lower than a hardness of a fore foot section of the lower midsole 4, and the hardness of the medial portion 31 of the fore foot section of the upper midsole 3 is lower than a hardness of a lateral portion 30 of the fore foot section of the upper midsole 3.

Now, as a shoe sole for correcting bowlegs, a shoe is known (JP 2005-224335 A) in which an easily-compressed layer is provided in a medial side layer below an elastic intermediate layer. However, with this shoe sole in which an easily-compressed layer is inserted below the elastic intermediate layer, the deformation of the easily-compressed layer is likely to delay when an impact load on the foot sole is imparted upon the sole due to the viscosity present in the elastic body of a resin such as EVA.

Therefore, although this conventional technique may be helpful for correcting bowlegs through static deformation, one cannot expect an advantageous effect against the impact load such as those from landing on one foot in tennis, etc.

In contrast, according to the second invention, the medial portion 31 of the fore foot section of the upper midsole 3 has a low hardness, and the medial portion 31 of the upper midsole 3 is therefore compressed instantaneously by an impact load, thereby bringing the direction of the ground reaction force vector F1 and the direction of the lower limb vector F2 shown in FIGS. 7A and 7B closer to each other. Therefore, when the invention is applied to tennis shoes for women, the moment M occurring at the knee will be small.

On the other hand, if the hardness of the medial side of the fore foot section of the midsole is lowered without using an upper-lower two-layer structure, the amount of compression on the medial side of the fore foot section will be excessive, and a difference is therefore likely to occur between the direction of the ground reaction force vector F1 and the direction of the lower limb vector F2.

Preferably, a low-hardness area of the upper midsole 3 where the hardness is low is provided over an area extending from a shaft of a metatarsal bone of a first toe to a head of a proximal phalanx of the first toe.

By employing such an extent for the low-hardness area, the foot is likely to be tilted in the medial-side fore foot portion.

Preferably, the medial portion 31 of the upper midsole 3 is set to 40 degrees to 55 degrees in JIS-C hardness, and the lateral portion 30 of the upper midsole 3 is set to 50 degrees to 65 degrees in JIS-C hardness.

Note that the hardness difference between the medial portion 31 of the upper midsole 3 and the lateral portion 30 of the upper midsole 3 is preferably about 5° to about 15° in JIS-C hardness.

With such a hardness difference therebetween, the tilt angle of the foot will be of an appropriate value.

If the hardness is lower than such hardness settings, the entire sole is typically likely to sink, whereas if the hardness is higher than the hardness settings, it is typically difficult to achieve a level of flexibility that is needed for the sole.

Preferably, the hardness of the medial portion 31 of the upper midsole 3 is lower than a hardness of a central portion 34, 44 of the upper midsole 3 or the lower midsole 4 in a medial and lateral direction;

a hardness of a lateral portion 30, 40 of the upper midsole 3 or lower midsole 4 is higher than the hardness of the central portions 34, 44 of the upper midsole 3 or the lower midsole 4 in the medial and lateral direction.

If the central portions 34, 44 have such an intermediate hardness between the hardness of the medial portion and the lateral portion, it will be easy to achieve a smooth slope of the midsole.

Thus, the second invention in another aspect is a shoe sole including an outsole 2 having a tread surface to be in contact with a ground upon landing, and a midsole 1 arranged on the outsole 2 and formed by a foamed body of a resin, the midsole 1 including:

a lateral portion 30, 40 covering a lower surface of a metatarsal bone of a fifth toe from a head to a bottom thereof;

a medial portion 31, 41 covering a lower surface of a metatarsal bone of a first toe from a head to a bottom thereof and a lower surface of a first proximal phalanx; and a central portion 34, 44 between the lateral portion 30, 40 and the medial portion 31, 41, wherein:

the lateral portion 30, 40 has a layer of a first hardness;

the central portion 34, 44 has a layer of a second hardness lower than the first hardness; and the medial portion 31, 41 has a layer of a third hardness lower than the second hardness.

In the second invention, the midsole 1 includes a layer of a lower midsole 4 and a layer of an upper midsole 3 arranged on the lower midsole 4;

the layer of the first hardness is provided in one of the upper midsole 3 and the lower midsole 4 in the lateral portions 30, 40; and the layer of the third hardness is provided in one of the upper midsole 3 and the lower midsole 4 in the medial portions 31, 41.

Embodiment

The present invention will be understood more clearly from the following description of preferred embodiments taken in conjunction with the accompanying drawings. Note however that the embodiments and the drawings are merely illustrative, and should not be relied upon in defining the scope of the present invention. The scope of the present invention shall be defined only by the appended claims. In the accompanying drawings, like reference numerals denote like components throughout the plurality of figures.

One embodiment of the present invention will now be described with reference to FIGS. 1 to 6D.

As shown in FIGS. 1 to 3A, the shoe sole is suitable for tennis shoes for women, for example, including an outsole 2 having a tread surface to be in contact with the road surface, and a midsole 1 arranged on the outsole 2.

The midsole 1 is formed by, for example, a material suitable for impact absorption such as a foamed body of a resin such as EVA (ethylene-vinyl acetate copolymer). On the other hand, the outsole 2 is formed by, for example, a material having a good abrasion resistance such as a foamed body or a non-foamed body of a rubber.

As shown in FIG. 1, the midsole 1 includes a lower midsole 4 of the lower layer, and an upper midsole 3 of the upper layer arranged on the lower midsole 4 and supporting the fore foot section of the foot. A lateral roll-up portion 42 for supporting a lateral side of the foot from the side of the foot is formed integrally with the lower midsole 4. The lower midsole 4 is provided over the entire length of the foot, whereas the upper midsole 3 is provided over a front-half area of the foot.

The hardness of a lateral portion 40 of the lower midsole 4 including the lateral roll-up portion 42 is a first hardness. The hardness of a medial portion 41 of the lower midsole 4 is a second hardness lower than the first hardness. The hardness of a lateral portion 30 of the upper midsole 3 is a third hardness lower than the first hardness. The hardness of a medial portion 31 of the upper midsole 3 is a fourth hardness lower than the second hardness and the third hardness.

More specifically, the lateral portion 30 of the upper midsole 3 and the medial portion 41 of the lower midsole 4 are set to an intermediate hardness, e.g., about 50 degrees to about 65 degrees, and more preferably about 54 degrees to about 62 degrees, in JIS-C hardness. Note that the hardness of the lateral portion 30 of the upper midsole 3 and the hardness of the medial portion 41 of the lower midsole 4 may be about the same or may be slightly different from each other.

Figure 4:
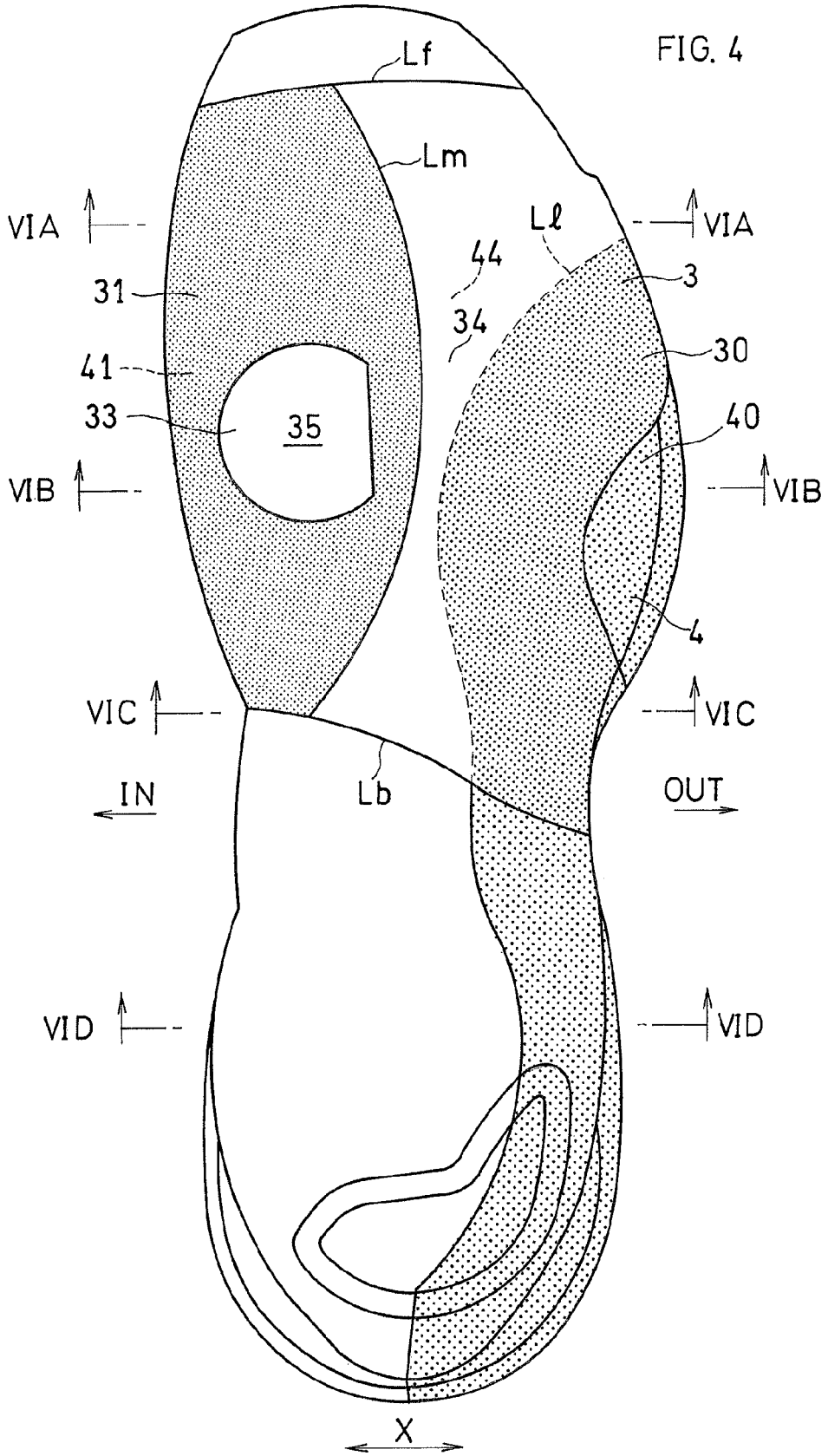
FIG. 4 is a plan view of the midsole.

On the other hand, the lateral portion 40 of the lower midsole 4 is set to a high hardness and is thick (coarsely) dotted in FIGS. 1 and 4. For example, the hardness is set to about 55 degrees to about 75 degrees, and more preferably about 61 degrees to about 69 degrees, in JIS-C hardness.

The medial portion 31 of the upper midsole 3 is set to a low hardness and is densely dotted in FIGS. 1 and 4. For example, the hardness is set to about 40 degrees to about 55 degrees, and more preferably about 44 degrees to about 52 degrees, in JIS-C hardness.

Note that in FIG. 4, a portion of the area of the lower midsole 4 set to a high hardness over which the upper midsole 3 is arranged is dotted with an intermediate density between the coarse dotting and the dense dotting.

Figure 2:
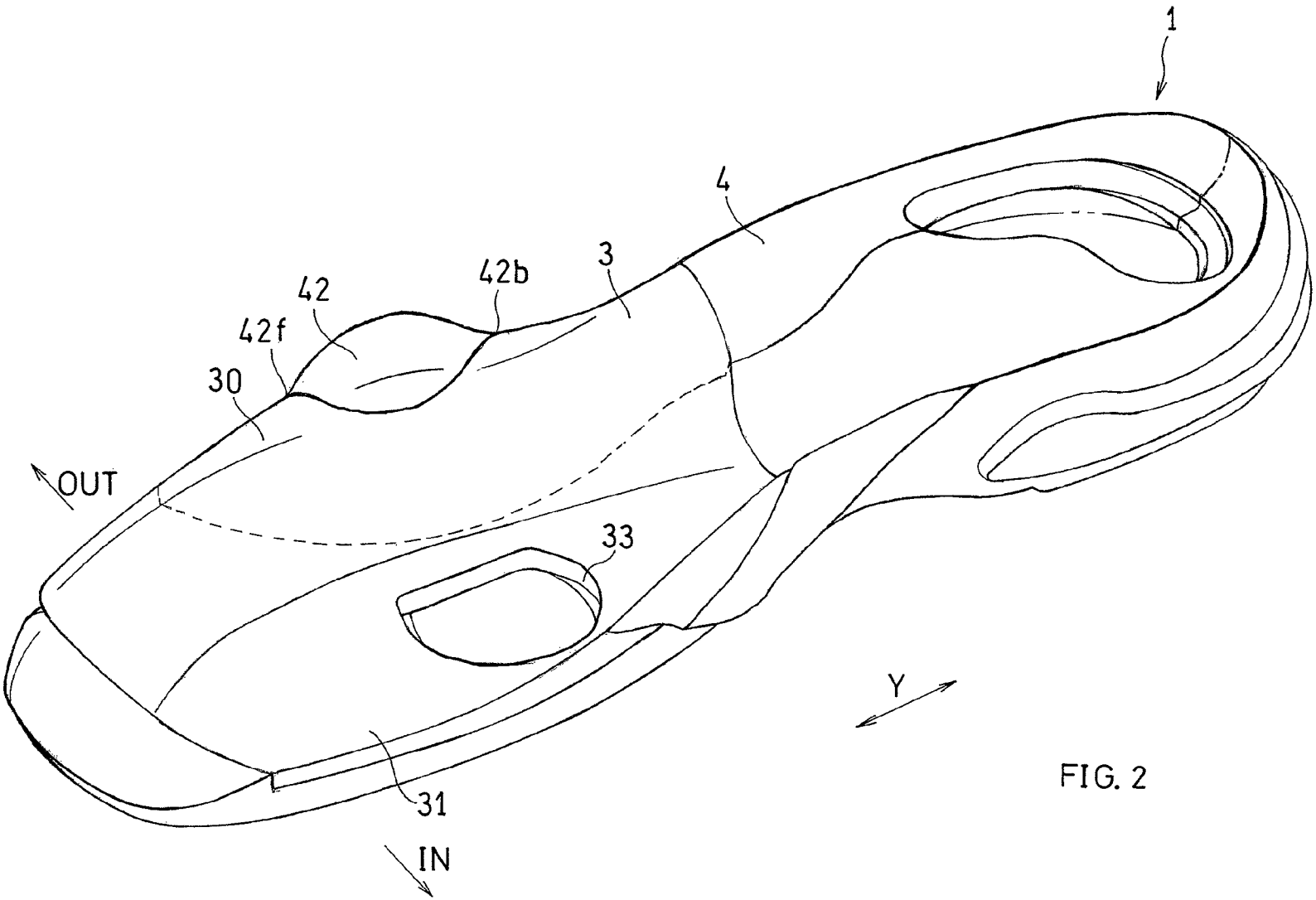
FIG. 2 is a perspective view of a midsole showing an upper midsole placed on a lower midsole.

As shown in FIGS. 1 and 2, a part or a whole of the high-hardness lateral roll-up portion 42 is protruding in an upward direction past the upper midsole 3 on a lateral side of the upper midsole 3 so that the lateral side of the foot is supported by the lateral roll-up portion 42 from the side of the foot without being supported by the upper midsole 3 from the side of the foot.

Figure 3A:
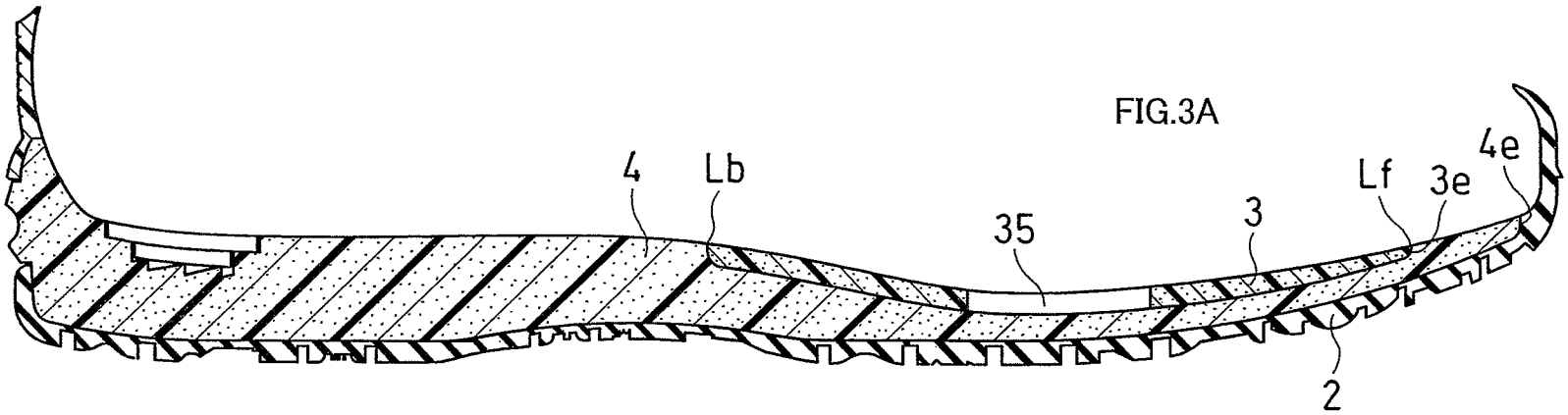
FIG. 3A is a longitudinal cross-sectional view of a shoe sole.
Figure 3B:
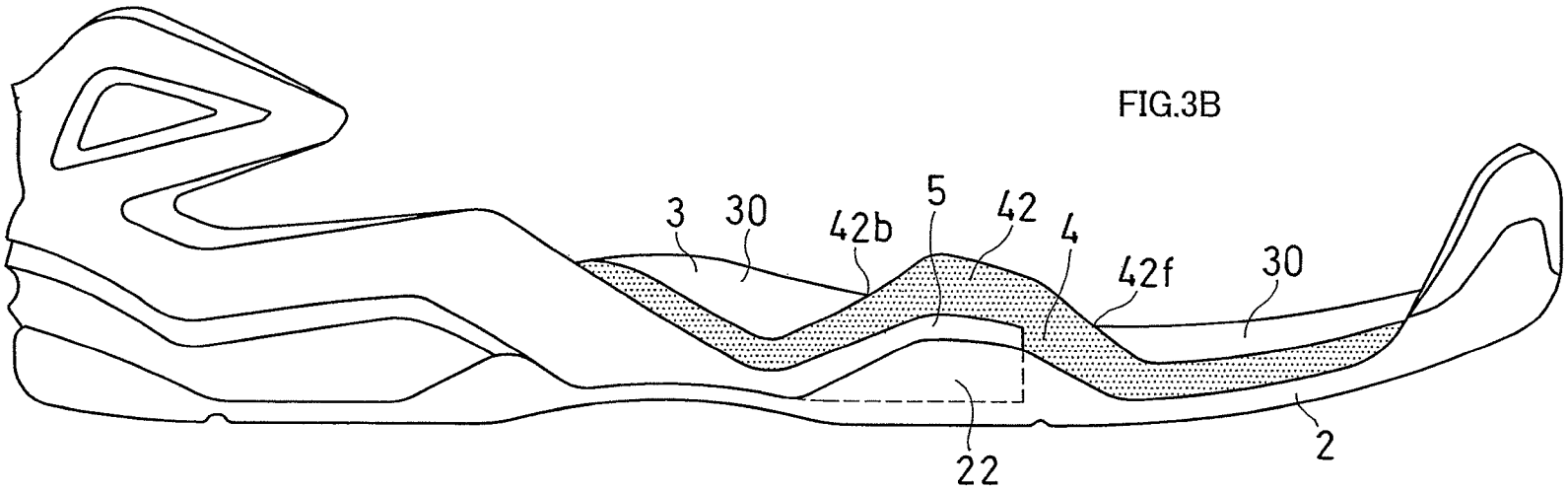
FIG. 3B is a lateral side view of the shoe sole.

As shown in FIG. 3B, when the shoe sole is viewed from the lateral side surface, the lateral roll-up portion 42 is protruding in the upward direction past the upper midsole 3, and there is a portion of the lateral portion 30 of the upper midsole 3 that is hidden by the lateral roll-up portion 42 and cannot be seen from the lateral side surface. That is, as seen from the lateral side surface, the lateral roll-up portion 42 of the lower midsole 4 supporting the side of the foot is located between the lateral portions 30, 30 of the upper midsole 3, and in other words, the lateral portions 30, 30 of the upper midsole 3 are exposed anterior and posterior of the lateral roll-up portion 42.

Note that the lateral portion 30 of the upper midsole 3 may be rolled up slightly in the upward direction.

Figure 5:
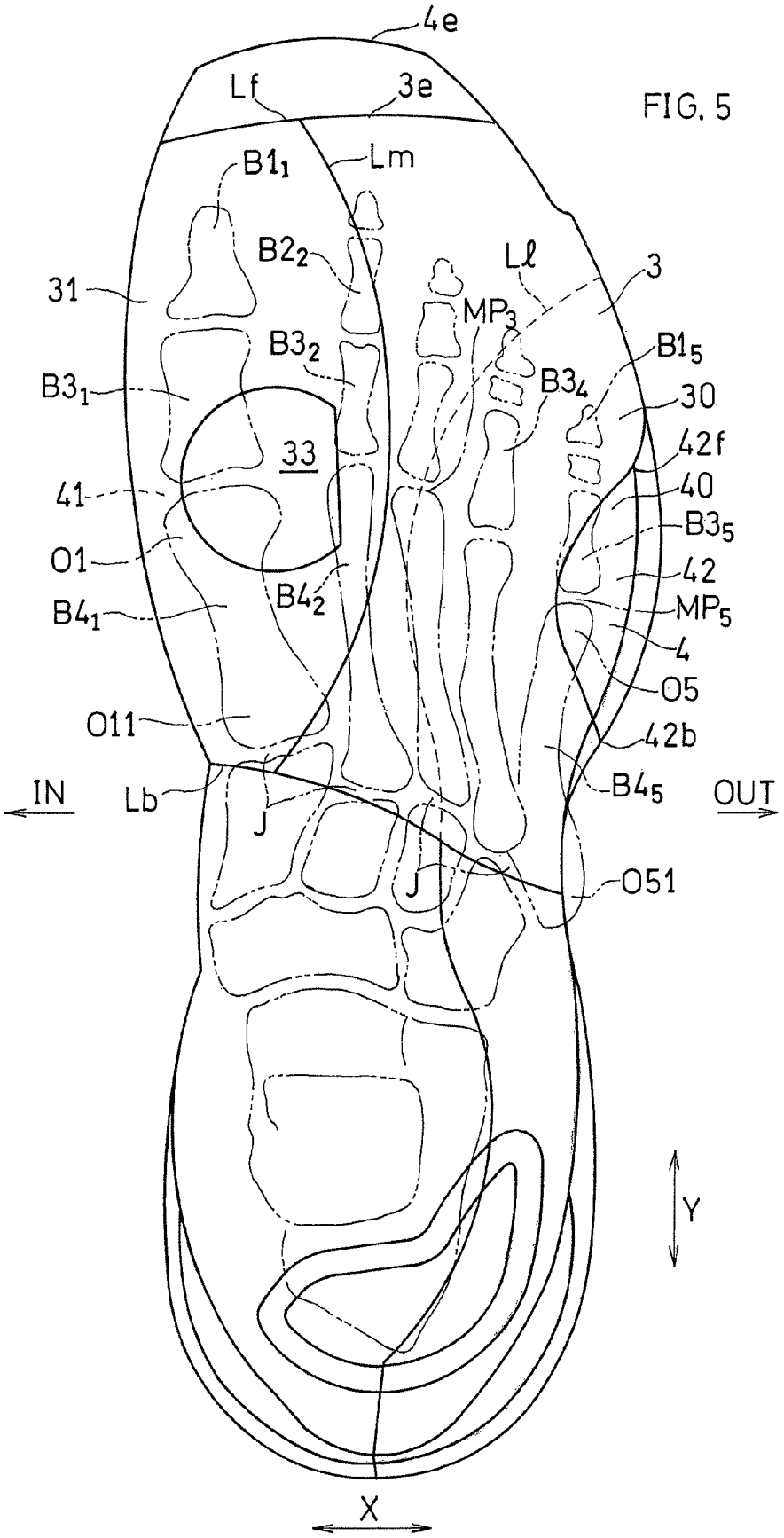
FIG. 5 is a plan view showing the relationship between the midsole and the foot bone structure.

In the case of the present embodiment, the lateral portion 30 of the upper midsole 3 of FIG. 5 is hollowed out and narrowed in the area of the head 05 of the metatarsal bone of the fifth toe. That is, in this area, the outer edge line of the lateral portion 40 of the lower midsole 4 is curved so as to protrude toward the lateral side, whereas the outer edge line of the lateral portion 30 of the upper midsole 3 is curved so as to protrude toward the medial side.

Specifically, the lateral portion 30 of the upper midsole 3 is not covering at least one portion of an MP joint $MP_5$ of the fifth toe, and the lateral portion 40 of the lower midsole 4 covers at least one portion of the MP joint $MP_5$ of the fifth toe.

Figure 6A:
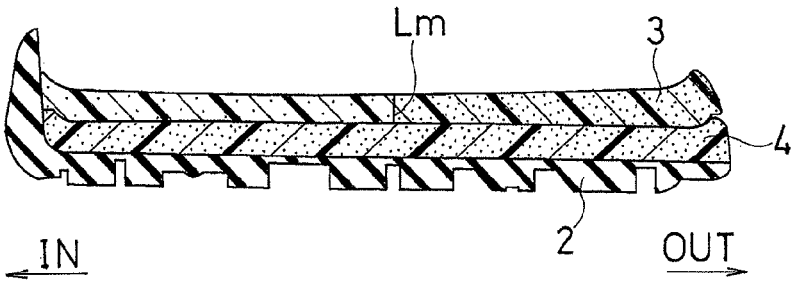
FIGS. 6A, 6B, 6C, and 6D are cross-sectional views taken along lines VIA-VIA, VIB-VIB, VIC-VIC and VID-VID of FIG. 4, respectively.
Figure 6B:
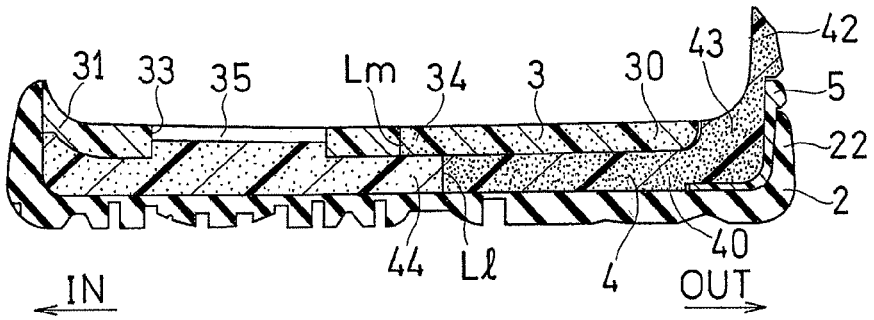
Figure 6C:
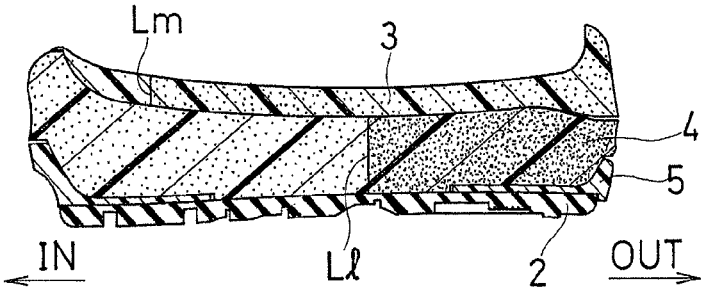

As shown in FIGS. 1 and 2, the lateral roll-up portion 42 of the lower midsole 4 is rolled up in the upward direction in the narrowed area of the upper midsole 3. As the lateral portion 30 of the upper midsole 3 is narrowed as described above, a base portion 43 of the lateral roll-up portion 42 of the lower midsole 4 has a large thickness, as shown in FIG. 6B, thereby enhancing the lateral shake preventing effect by the lateral roll-up portion 42.

Specifically, as the lateral portion 30 of the upper midsole 3 is narrowed, the lateral portion 30 does not extend to the base portion 43, and the thickness of the base portion 43 capable of supporting the load from above is larger than other areas of the lateral portion 40 of the lower midsole 4, thereby making it less likely that the lateral roll-up portion 42 collapses due to the force which laterally shakes the foot toward the lateral side.

The lateral roll-up portion 42 protruding in the upward direction past the upper midsole 3 has an anterior end 42*f* and a posterior end 42*b* in the longitudinal direction Y. The anterior end 42*f* is located anterior to the MP joint $MP_5$ of the fifth toe and posterior to the tip of the fifth distal phalanx $B1_5$, whereas the posterior end 42*b* is located posterior to the MP joint $MP_5$ of the fifth toe and anterior to the bottom 051 of the metatarsal bone $B4_5$ of the fifth toe.

The lateral portion 30 of the upper midsole 3 supports the lower surface of the lateral side of the fore foot section of the foot. As shown in FIGS. 5 and 6B, the high-hardness lateral roll-up portion 42 of the lower midsole 4 covers the lateral side surface of the head 05 of the metatarsal bone of the fifth toe so as to support the lateral side of the head in the fore foot section.

At least a portion of the proximal phalanx $B3_5$ of the fifth toe and at least a portion of the metatarsal bone $B4_5$ of the fifth toe may be covered by the lateral portion 40 of the lower midsole 4 from below.

Specifically, as shown in FIG. 5, the lateral portion 30 of the upper midsole 3 is not covering at least one portion of the head 05 of the metatarsal bone and/or at least one portion of the MP joint $MP_5$ of the fifth toe, and these areas are covered from below by the lateral portion 40 of the lower midsole 4.

The lateral portion 30 of the upper midsole 3 is at least covering a portion of the distal phalanx $B1_5$ of the fifth toe and a portion of the metatarsal bone $B4_5$ of the fifth toe. That is, in the vicinity of the MP joint $MP_5$ of the fifth toe or the head 05 of the metatarsal bone of the fifth toe, the lateral portion 40 of the lower midsole 4 is exposed, and at least the distal phalanx $B1_5$ of the fifth toe and a portion of the metatarsal bone $B4_5$ of the fifth toe are covered from below by the lateral portion 30 of the upper midsole 3 and the lateral portion 40 of the lower midsole 4.

As shown in FIG. 5, the high-hardness lateral portion 40 of the lower midsole 4 may be provided to extend along the lateral side of the midsole 1 to the posterior end of the midsole 1, covering an area posterior to the forth and fifth proximal phalanges $B3_4$ and $B3_5$. The high-hardness area may be arranged so as to bulge toward the central portion in the fore foot portion.

That is, the lateral line Ll, defining the high-hardness area, is curved so as to protrude toward the medial side in the fore foot portion, and is extending on the medial side of the MP joint $MP_5$ of the fifth toe.

On the other hand, the low-hardness medial portion 31 of the upper midsole 3 may be arranged over an extent that covers the first and second metatarsal bones $B4_1$ and $B4_2$, the first and second proximal phalanges $B3_1$ and $B3_2$, the first distal phalanx $B1_1$ and the medial cuneiform bone, and may be covering the second middle phalanx $B2_2$. The low-hardness area may be arranged so as to bulge toward the central portion in the fore foot portion.

That is, the medial line Lm, defining the low-hardness area, is curved so as to protrude toward the lateral side in the fore foot portion, and is extending on the lateral side of the head 01 of the metatarsal bone of the first toe.

Note that the lateral line Ll and the medial line Lm may come closest to each other in the vicinity of the MP joint $MP_3$ of the third toe.

In FIG. 5, the high-hardness lateral portion 40 of the lower midsole 4 covers the lower surface of the head 05 to the bottom 051 of the metatarsal bone of the fifth toe. The medial portion 41 of the lower midsole 4 set to the intermediate hardness covers the lower surface of the head 01 to the bottom 011 of the metatarsal bone of the first toe and the proximal phalanx $B3_1$.

In FIG. 5, the lateral portion 30 of the upper midsole 3 set to the intermediate hardness covers the lower surface of the head 05 to the bottom 051 of the metatarsal bone of the fifth toe. The medial portion 31 of the upper midsole 3 set to the lower hardness covers the lower surface of the head 01 to the bottom 011 of the metatarsal bone of the first toe and the proximal phalanx $B3_1$, and this low-hardness area is preferably provided at least over an area from the shaft of the first metatarsal bone $B4_1$ to the head of the first proximal phalanx $B3_1$.

As the areas are set as described above, the hardness of the medial portion 31 of the upper midsole 3 is lower than the hardness of a central portion 34, 44 of the upper midsole 3 or the lower midsole 4 in the medial-lateral direction, and the hardness of the lateral portion 30, 40 of the upper midsole 3 or the lower midsole 4 is higher than the hardness of the central portion 34, 44 of the upper midsole 3 or the lower midsole 4 in the medial-lateral direction.

That is, as shown in FIG. 4, in the fore foot portion, the lateral portion 30, 40 has a layer of the first hardness, the central portion 34, 44 has a layer of the second hardness lower than the first hardness, and the medial portion 31, 41 has a layer of the third hardness lower than the second hardness.

Specifically, as shown in FIG. 4, for example, in the area between the front line Lf and the back line Lb in the fore foot portion, the coarsely-dotted area on the lateral side of the lateral line Ll is the layer of the first hardness including the high-hardness lower midsole 4 and the intermediate-hardness upper midsole 3, whereas the densely-dotted area on the medial side of the medial line Lm is the layer of the third hardness including the intermediate-hardness lower midsole 4 and the low-hardness upper midsole 3. The undotted area between the first layer and the third layer is the layer of the second hardness including the intermediate-hardness lower midsole 4 and the intermediate-hardness upper midsole 3.

As shown in FIGS. 4 and 5, the medial line Lm and the lateral line Ll are each bulging toward the center in the width direction X, and come closest to each other in the vicinity of the MP joint $MP_3$ of the third toe. That is, in the fore foot portion, the width of the layer of the second hardness is smaller in the central portion thereof, and larger in the area anterior to the central portion and in the area posterior to the central portion, like an hourglass.

Note that the layer of the first hardness may be provided in either the upper midsole 3 or the lower midsole 4 in the lateral portion 30, 40, and the layer of the third hardness may be provided in either the upper midsole 3 or the lower midsole 4 in the medial portion 31, 41.

In FIG. 1, a through hole 33 is formed in the medial portion 31 of the upper midsole 3. The through hole 33 is provided at the position of the ball 01 of the big toe as shown in FIG. 5. As shown in FIG. 6B, the through hole 33 is filled with a low-resilience part 35 of a foamed resin. The hardness of the low-resilience part 35 is even lower than the hardness of the medial portion 31 of the upper midsole 3, and is set to about 22 degrees to about 28 degrees in JIS-C hardness.

As shown in FIG. 6B, the lower midsole 4 may be slightly bulging in the area where the through hole 33 is provided, so that the thickness of the low-resilience part 35 is smaller than the thickness of the upper midsole 3. Then, it is possible to prevent the foot sole from sinking excessively in the area of the low-resilience part 35.

Note that the through hole 33 and the low-resilience part 35 do not always need to be provided.

Figure 6D:
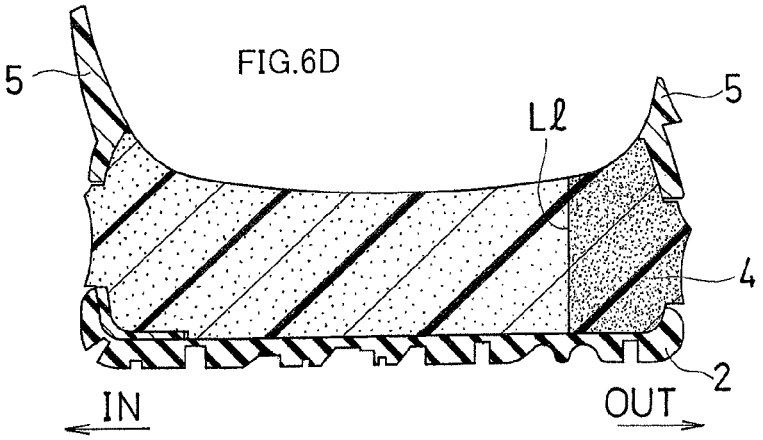

As shown in FIGS. 3B, 6B and 6D, the stabilizer 5 for preventing a lateral shake may be provided. The stabilizer 5 is made of a non-foamed body of a resin, and the like, and is arranged along the lateral side surface of the lateral roll-up portion 42 further on the lateral side of the lateral roll-up portion 42. The height of the stabilizer 5 is less than the height of the lateral roll-up portion 42.

As shown in FIGS. 3B and 6B, in the area of the lateral roll-up portion 42, a roll-up portion 22 of the outsole 2 is provided further on the lateral side of the stabilizer 5. The roll-up portion 22 is rolled up in the upward direction further on the lateral side of the lateral roll-up portion 42, serving to prevent a lateral shake of the ball 05 of the little toe. The height of the roll-up portion 22 is less than the height of the lateral roll-up portion 42.

That is, as shown in FIG. 3B, when the shoe sole of the present invention is seen from the lateral side surface, in the area of the lateral roll-up portion 42 of the lower midsole 4, the stabilizer 5 is located at a level above the roll-up portion 22 of the outsole 2, and the lateral roll-up portion 42 of the lower midsole 4 is located at a level above the stabilizer 5.

In the present shoe sole, the lateral roll-up portion 42 is formed by the lower midsole 4 made of a foamed body of a resin, the height (level) of the rubber outsole and the height of the stabilizer made of a non-foamed body of a resin, and the like, are set to be lower than the lateral roll-up portion 42 in the area of the lateral roll-up portion 42. This realizes an appropriate hardness and a light weight of the shoe sole, and it will unlikely lead to a decrease in the bendability of the foot at the MP joint or a decrease in the athletic functionality.

The upper midsole 3 and the lower midsole 4 of the midsole 1 may be separately molded in primary molding, and may then be bonded together or molded together in secondary molding. Alternatively, only the intermediate-hardness area 41, 30 of FIG. 6B may be molded in primary molding, and the low-hardness and high-hardness areas may be molded with the intermediate-hardness areas, which have been molded in primary molding, inserted in the mold.

As shown in FIGS. 3A and 5, the front line Lf and the back line Lb may define an area of the lower midsole 4 where the upper midsole 3 is arranged, and the lower midsole 4 may have steps along the front line Lf and the back line Lb so that the lower midsole 4 is dented down across the area. That is, the lower midsole 4 may be formed so as to have a depressed cross section.

Specifically, as shown in FIG. 3A, in the vicinity of the back line Lb, the area posterior to the back line Lb may have an abruptly-increased thickness from the area anterior to the back line Lb. On the other hand, in the vicinity of the front line Lf, the area anterior to the front line Lf may have an abruptly-increased thickness from the area posterior to the front line Lf.

The upper midsole 3 is fitted into the depressed portion of the lower midsole 4. That is, the upper midsole 3 does not extend to the anterior end 4*e* of the lower midsole 4, and the anterior end 4*e* of the lower midsole 4 is located anterior to the anterior end 3*e* of the upper midsole 3.

Figure 8A:
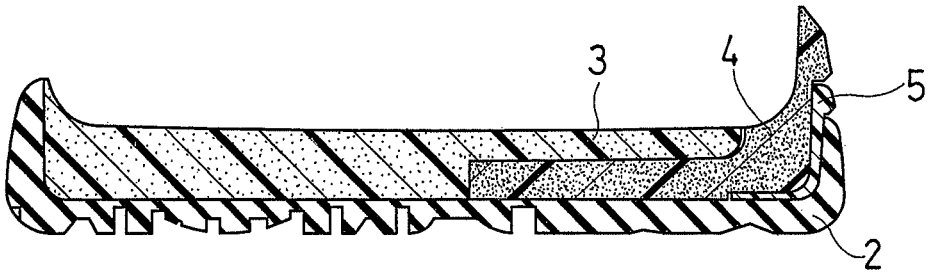
FIGS. 8A, 8B, and 8C are cross-sectional views taken along line VIB-VIB of FIG. 4, each showing a variation of the midsole.
Figure 8B:
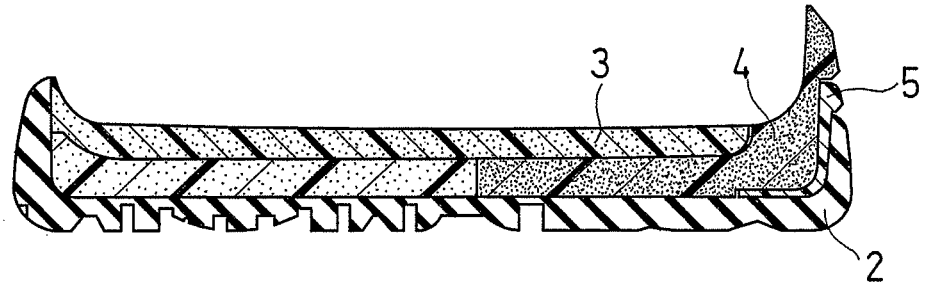
Figure 8C:
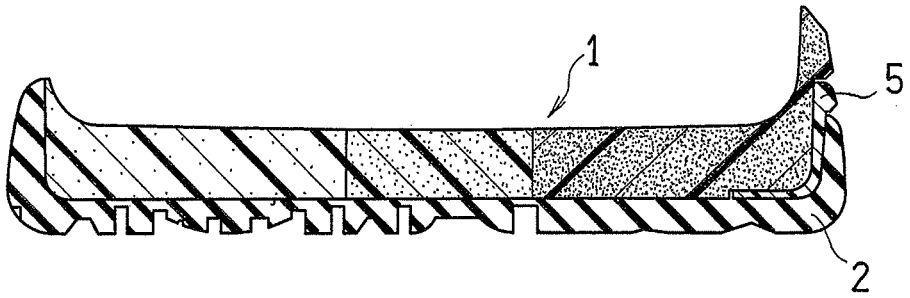

FIGS. 8A to 8C each show a variation of the midsole of the embodiment.

As shown in FIG. 8A, the lower midsole 4 may only include the lateral portion 40 so that the midsole is formed by two layers of the lower midsole 4 and the upper midsole 3 on the lateral side OUT of the shoe. On the medial side IN of the shoe, the midsole may be formed by a single upper midsole 3 whose thickness is equal to the two layers.

For other than tennis shoes for women, e.g., for tennis shoes for men or shoes for other court sports, the upper midsole 3 with no hardness difference between the lateral side and the medial side may be arranged on the lower midsole 4 as shown in FIG. 8B.

As shown in FIG. 8C, a high-hardness layer (the layer of the first hardness) may be provided on the lateral side OUT of the shoe, an intermediate-hardness layer (the layer of the second hardness) in the central portion, and a low-hardness layer (the layer of the third hardness) on the medial side IN.

While preferred embodiments have been described above with reference to the drawings, various obvious changes and modifications will readily occur to those skilled in the art upon reading the present specification.

For example, the hardness of the lateral portion 30 of the upper midsole 3 and the hardness of the medial portion 41 of the lower midsole 4 may be generally equal to each other or may be different from each other.

For tennis shoes for men, the medial portion 31 of the upper midsole 3 may be set to a hardness generally equal to the hardness of the lateral portion 30 or that of the medial portion 41 of the lower midsole 4. That is, for example, the hardness of the medial portion and that of the lateral portion of the upper midsole 3 may be set to a certain hardness (a generally equal hardness).

For tennis shoes for women, the lateral portion 40 of the lower midsole 4 may be set to a hardness generally equal to the hardness of the medial portion 41 of the lower midsole 4 or that of the lateral portion 30 of the upper midsole 3.

Thus, such changes and modifications are deemed to fall within the scope of the present invention, which is defined by the appended claims.

INDUSTRIAL APPLICABILITY

The present invention is applicable to a shoe sole for court sports such as tennis and basketball.

REFERENCE SIGNS LIST

1: Midsole
2: Outsole 22: Roll-up portion
3: Upper midsole 30: Lateral portion 31: Medial portion 32: Roll-up portion 33: Through hole 34: Central portion 35: Part 3*e*: Anterior end
4: Lower midsole 40: Lateral portion 41: Medial portion 42: Lateral roll-up portion 43: Base portion 44: Central portion 4*e*: Anterior end
5: Stabilizer
CL: Central axis
F1: Ground reaction force vector F2: Lower limb vector
Lf: Front line Lb: Back line Ll: Lateral line Lm: Medial line
M: Moment
IN: Medial side OUT: Lateral side
Y: Longitudinal direction X: Width direction

What is claimed is:

1. A shoe sole comprising an outsole having a tread surface to be in contact with a road surface, and a midsole arranged on the outsole, wherein:

the midsole includes a lower midsole of a lower layer formed by a foam body of a resin, and an upper midsole of an upper layer formed by a second foam body of a resin and arranged on the lower midsole;

a lateral roll-up portion configured to support a lateral side of a foot from a side of the foot is formed integrally with the lower midsole;

the lower midsole includes a lateral portion and a medial portion;

the lateral portion of the lower midsole including the lateral roll-up portion has a first hardness;

the medial portion of the lower midsole has a second hardness that is lower than the first hardness;

a lateral portion of the upper midsole has a third hardness that is lower than the first hardness; and a part or a whole of the lateral roll-up portion is configured to protrude in an upward direction past the upper midsole on a lateral side of the upper midsole so that the lateral side of the foot is supported by the lateral roll-up portion from the side of the foot without being supported by the upper midsole from the side of the foot, wherein the lateral portion of the upper midsole has a hollowed out and narrowed portion in an area adapted to a metatarsophalangeal joint of a fifth toe, hollowed out and narrowed portion defined by a line that is curved so as to protrude toward a medial side;

an outer edge line of the lateral portion of the upper midsole is curved so as to protrude toward a lateral side in an area anterior to a most narrowed portion of the hollowed out and narrowed portion, the outer edge line of the lateral portion of the upper midsole is curved so as to protrude toward the lateral side in an area posterior to the most narrowed portion of the hollowed out and narrowed portion;

the lateral portion of the lower midsole forms a base portion that is configured to cover from below at least a part of the metatarsophalangeal joint of the fifth toe;

the base portion of the lower midsole fills the hollowed out and narrowed portion; and the lateral roll-up portion of the lower midsole rolls up in the upward direction in a lateral edge of the base portion.

2. The shoe sole according to claim 1, wherein:

the lateral portion of the upper midsole is configured to support a lower surface of a lateral side of a fore foot section of the foot; and the lateral roll-up portion of the lower midsole is configured to cover a lateral side surface of a head of a metatarsal bone of the fifth toe so as to support a lateral side of the head in the fore foot section.

3. The shoe sole according to claim 2, wherein:

the lateral portion of the lower midsole is configured to cover a lower surface of the metatarsal bone of the fifth toe from the head to a bottom thereof; and the medial portion of the lower midsole is configured to cover a lower surface of a metatarsal bone of a first toe from a head to a bottom thereof and a lower surface of a proximal phalanx.

4. The shoe sole according to claim 3, wherein a hardness of a medial portion of the upper midsole is a fourth hardness lower than the second hardness and the third hardness.

5. The shoe sole according to claim 3, wherein:

the lateral portion of the upper midsole is configured to cover the lower surface of the metatarsal bone of the fifth toe from the head to the bottom thereof; and the medial portion of the upper midsole is configured to cover the lower surface of the metatarsal bone of the first toe from the head to the bottom thereof and a lower surface of the proximal phalanx.

6. The shoe sole according to claim 1, wherein the hollowed out and narrowed portion of the lateral portion of the upper midsole is configured so that at least one portion of the metatarsophalangeal joint of the fifth toe protrudes over the hollowed out and narrowed portion, and the base portion of the lateral portion of the lower midsole is configured to cover the at least one portion of the metatarsophalangeal joint of the fifth toe.

7. The shoe sole according to claim 1, further comprising a stabilizer arranged along a lateral side surface of the lateral roll-up portion further on a lateral side of the lateral roll-up portion, wherein the lateral roll-up portion protrudes in the upward direction past the stabilizer.

8. The shoe sole according to claim 1, wherein the outsole is formed by a foam body or a non-foam body of a rubber and is rolled up in the upward direction further on a lateral side of the lateral roll-up portion, and the lateral roll-up portion protrudes in the upward direction past a rolled-up portion of the outsole.

9. The shoe sole according to claim 1, wherein the lower midsole includes a part on which a whole of the upper midsole is downwardly projected, and the whole of the upper midsole is arranged above the part of the lower midsole.

10. The shoe sole according to claim 1, wherein a whole of the upper midsole is made of the second foam body.

11. The shoe sole according to claim 1, wherein the lower midsole includes a part on which a whole of the upper midsole is downwardly projected, the whole of the upper midsole is arranged above the part of the lower midsole, and a whole of the upper midsole is made of the second foam body.

* * * * *